US008246903B2

(12) United States Patent
Miller et al.

(10) Patent No.: US 8,246,903 B2
(45) Date of Patent: Aug. 21, 2012

(54) DYNAMIC DEHYDRIDING OF REFRACTORY METAL POWDERS

(75) Inventors: Steven A. Miller, Canton, MA (US); Mark Gaydos, Nashua, NH (US); Leonid N. Shekhter, Ashland, MA (US); Gokce Gulsoy, Newton, MA (US)

(73) Assignee: H.C. Starck Inc., Newton, MA (US)

( * ) Notice: Subject to any disclaimer, the term of this patent is extended or adjusted under 35 U.S.C. 154(b) by 863 days.

(21) Appl. No.: 12/206,944

(22) Filed: Sep. 9, 2008

(65) Prior Publication Data

US 2010/0061876 A1 Mar. 11, 2010

(51) Int. Cl.
*B22F 3/12* (2006.01)

(52) U.S. Cl. ..... 419/31

(58) Field of Classification Search ..... None
See application file for complete search history.

(56) References Cited

U.S. PATENT DOCUMENTS

| | | | |
|---|---|---|---|
| 3,436,299 | A | 4/1969 | Halek |
| 3,990,784 | A | 11/1976 | Gelber |
| 4,011,981 | A | 3/1977 | Danna et al. |
| 4,073,427 | A | 2/1978 | Keifert et al. |
| 4,140,172 | A | 2/1979 | Corey |
| 4,202,932 | A | 5/1980 | Chen et al. |
| 4,209,375 | A | 6/1980 | Gates et al. |
| 4,291,104 | A | 9/1981 | Keifert |
| 4,459,062 | A | 7/1984 | Siebert |
| 4,483,819 | A | 11/1984 | Albrecht et al. |
| 4,508,563 | A | 4/1985 | Bernard et al. |
| 4,510,171 | A | 4/1985 | Siebert |
| 4,537,641 | A | 8/1985 | Albrecht et al. |
| 4,722,756 | A | 2/1988 | Hard |
| 4,731,111 | A | 3/1988 | Kopatz et al. |
| 4,818,629 | A | 4/1989 | Jenstrom et al. |
| 4,915,745 | A | 4/1990 | Pollock et al. |
| 4,964,906 | A | 10/1990 | Fife |
| 5,061,527 | A | 10/1991 | Watanabe et al. |
| 5,091,244 | A | 2/1992 | Biornard |
| 5,147,125 | A | 9/1992 | Austin |
| 5,242,481 | A | 9/1993 | Kumar |
| 5,270,858 | A | 12/1993 | Dickey |
| 5,271,965 | A | 12/1993 | Browning |
| 5,302,414 | A | 4/1994 | Alkhimov et al. |

(Continued)

FOREIGN PATENT DOCUMENTS

DE 10253794 A1 6/2004

(Continued)

OTHER PUBLICATIONS

Tapphorn et al, The Solid-State Spray Forming of Low-Oxide Titanium Components, 45-47 JOM (Sep. 1998).*

(Continued)

*Primary Examiner* — Patrick Ryan
*Assistant Examiner* — Yoshitoshi Takeuchi
(74) *Attorney, Agent, or Firm* — Bingham McCutchen LLP

(57) ABSTRACT

Refractory metal powders are dehydrided in a device which includes a preheat chamber for retaining the metal powder fully heated in a hot zone to allow diffusion of hydrogen out of the powder. The powder is cooled in a cooling chamber for a residence time sufficiently short to prevent re-absorption of the hydrogen by the powder. The powder is consolidated by impact on a substrate at the exit of the cooling chamber to build a deposit in solid dense form on the substrate.

16 Claims, 2 Drawing Sheets

Simplified equipment schematic showing the different process conditions and where they exist within the device.

U.S. PATENT DOCUMENTS 5,305,946 A 4/1994 Heilmann
5,330,798 A 7/1994 Browning
5,580,516 A 12/1996 Kumar
5,612,254 A 3/1997 Mu et al.
5,679,473 A 10/1997 Murayama et al.
5,693,203 A 12/1997 Ohhashi et al.
5,795,626 A * 8/1998 Gabel et al. ..... 427/458
5,859,654 A 1/1999 Radke et al.
5,954,856 A 9/1999 Pathare et al.
5,972,065 A 10/1999 Dunn et al.
5,993,513 A 11/1999 Fife
6,030,577 A 2/2000 Commandeur et al.
6,136,062 A 10/2000 Loffelholz et al.
6,139,913 A 10/2000 Van Steenkiste
6,171,363 B1 1/2001 Shekhter et al.
6,189,663 B1 2/2001 Smith et al.
6,197,082 B1 3/2001 Dorvel et al.
6,238,456 B1 5/2001 Wolf et al.
6,245,390 B1 6/2001 Baranovski et al.
6,258,402 B1 7/2001 Hussary et al.
6,261,337 B1 7/2001 Kumar
6,328,927 B1 12/2001 Lo et al.
6,331,233 B1 12/2001 Turner
6,408,928 B1 6/2002 Heinrich et al.
6,444,259 B1 9/2002 Subramanian et al.
6,464,933 B1 * 10/2002 Popoola et al. ..... 419/2
6,482,743 B1 11/2002 Sato
6,491,208 B2 12/2002 James et al.
6,502,767 B2 1/2003 Kay et al.
6,521,173 B2 2/2003 Kumar et al.
6,558,447 B1 5/2003 Shekhter et al.
6,589,311 B1 7/2003 Han et al.
6,623,796 B1 9/2003 Van Steenkiste
6,669,782 B1 12/2003 Thakur
6,722,584 B2 4/2004 Kay
6,723,379 B2 4/2004 Stark
6,743,343 B2 6/2004 Kida et al.
6,743,468 B2 6/2004 Fuller et al.
6,749,002 B2 6/2004 Grinberg et al.
6,759,085 B2 7/2004 Muehlberger
6,770,154 B2 8/2004 Koenigsmann et al.
6,773,969 B2 8/2004 Lee et al.
6,780,458 B2 8/2004 Seth et al.
6,855,236 B2 2/2005 Sato et al.
6,872,425 B2 3/2005 Kaufold et al.
6,872,427 B2 3/2005 Van Steenkiste et al.
6,896,933 B2 5/2005 Van Steenkiste et al.
6,905,728 B1 6/2005 Hu et al.
6,911,124 B2 6/2005 Tang et al.
6,915,964 B2 7/2005 Tapphorn et al.
6,919,275 B2 7/2005 Chiang et al.
6,924,974 B2 8/2005 Stark
6,953,742 B2 10/2005 Chen et al.
6,962,407 B2 11/2005 Yamamoto et al.
7,053,294 B2 5/2006 Tuttle et al.
7,067,197 B2 6/2006 Michaluk et al.
7,081,148 B2 7/2006 Koenigsmann et al.
7,101,447 B2 9/2006 Turner
7,108,893 B2 9/2006 Steenkiste
7,128,988 B2 10/2006 Lambeth
7,143,967 B2 12/2006 Heinrich et al.
7,163,715 B1 1/2007 Kramer
7,164,205 B2 1/2007 Yamaji et al.
7,170,915 B2 1/2007 McDonald
7,175,802 B2 2/2007 Sandlin et al.
7,178,744 B2 2/2007 Tapphorn et al.
7,183,206 B2 2/2007 Shepard
7,192,623 B2 3/2007 Andre et al.
7,208,230 B2 4/2007 Ackerman et al.
7,244,466 B2 7/2007 Van Steenkiste et al.
7,278,353 B2 10/2007 Langan et al.
7,335,341 B2 2/2008 Van Steenkiste et al.
7,399,335 B2 7/2008 Shekhter et al.
7,402,277 B2 7/2008 Ayer et al.
7,479,299 B2 1/2009 Raybould et al.
7,514,122 B2 4/2009 Kramer
7,582,846 B2 9/2009 Molz et al.
7,618,500 B2 11/2009 Farmer et al.
7,670,406 B2 3/2010 Belashchenko
7,910,051 B2 3/2011 Zimmermann et al.
8,002,169 B2 8/2011 Miller et al.
8,043,655 B2 10/2011 Miller et al.
2002/0112789 A1 8/2002 Jepson et al.
2002/0112955 A1 8/2002 Aimone et al.
2003/0023132 A1 1/2003 Melvin et al.
2003/0190413 A1 10/2003 Van Steenkiste et al.
2003/0219542 A1 11/2003 Ewasyshyn et al.
2003/0232132 A1 12/2003 Muehlberger
2004/0037954 A1 2/2004 Heinrich et al.
2004/0065546 A1 4/2004 Michaluk et al.
2004/0076807 A1 4/2004 Grinberg et al.
2004/0126499 A1 7/2004 Heinrich et al.
2004/0202885 A1 10/2004 Seth et al.
2005/0084701 A1 4/2005 Slattery
2005/0120957 A1 6/2005 Kowalsky
2005/0142021 A1 6/2005 Aimone et al.
2005/0147742 A1 7/2005 Kleshock et al.
2005/0153069 A1 * 7/2005 Tapphorn et al. ..... 427/180
2005/0155856 A1 7/2005 Oda
2005/0220995 A1 10/2005 Hu et al.
2005/0252450 A1 11/2005 Kowalsky et al.
2006/0021870 A1 2/2006 Tsai et al.
2006/0027687 A1 2/2006 Heinrich et al.
2006/0032735 A1 2/2006 Aimone et al.
2006/0042728 A1 3/2006 Lemon et al.
2006/0045785 A1 3/2006 Hu et al.
2006/0090593 A1 5/2006 Liu
2006/0121187 A1 6/2006 Haynes et al.
2006/0251872 A1 11/2006 Wang
2007/0116886 A1 5/2007 Refke et al.
2007/0116890 A1 5/2007 Adams et al.
2007/0172378 A1 7/2007 Shibuya et al.
2007/0183919 A1 * 8/2007 Ayer et al. ..... 419/2
2007/0196570 A1 8/2007 Gentsch et al.
2008/0028459 A1 1/2008 Suh et al.
2008/0078268 A1 4/2008 Shekhter et al.
2008/0145688 A1 6/2008 Miller et al.
2008/0171215 A1 7/2008 Kumar et al.
2008/0216602 A1 9/2008 Zimmermann et al.
2008/0271779 A1 11/2008 Miller et al.
2009/0004379 A1 1/2009 Deng et al.
2009/0239754 A1 9/2009 Kruger et al.
2009/0291851 A1 11/2009 Bohn et al.
2010/0015467 A1 1/2010 Zimmermann et al.
2010/0055487 A1 3/2010 Zimmermann et al.
2010/0084052 A1 4/2010 Farmer et al.
2010/0086800 A1 4/2010 Miller et al.
2010/0136242 A1 6/2010 Kay et al.
2010/0172789 A1 7/2010 Calla et al.
2010/0189910 A1 7/2010 Belashchenko et al.
2010/0246774 A1 9/2010 Lathrop
2010/0272889 A1 10/2010 Shekhter et al.
2011/0132534 A1 6/2011 Miller et al.
2011/0300396 A1 12/2011 Miller et al.
2011/0303535 A1 12/2011 Miller et al.

FOREIGN PATENT DOCUMENTS

EP 0074803 A1 3/1983
EP 0484533 A1 5/1992
EP 0774315 A2 5/1997
EP 1066899 A2 1/2001
EP 1138420 A2 10/2001
EP 1350861 A1 10/2003
EP 1382720 A2 1/2004
EP 1398394 3/2004
EP 1413642 A1 4/2004
EP 1452622 9/2004
EP 1715080 10/2006
GB 2121441 A 12/1983
GB 2394479 A 4/2004
JP 54067198 5/1979
JP 3197640 8/1991
JP 06346232 A 12/1994
JP 11269639 10/1999
JP 01/131767 5/2001
JP 03/301278 10/2003
RU 2166421 C1 5/2001

| | | | |
|---|---|---|---|
| WO | WO-9837249 | | 8/1998 |
| WO | WO-0112364 | A1 | 2/2001 |
| WO | WO-02064287 | A2 | 8/2002 |
| WO | WO-02/070765 | | 9/2002 |
| WO | WO-03062491 | A2 | 7/2003 |
| WO | WO-03106051 | A1 | 12/2003 |
| WO | WO-2004074540 | A1 | 9/2004 |
| WO | WO-2005073418 | A1 | 8/2005 |
| WO | WO-2005/079209 | | 9/2005 |
| WO | WO-2006117145 | A2 | 11/2006 |
| WO | WO-2007/001441 | | 1/2007 |
| WO | WO-2008/063891 | | 5/2008 |
| WO | WO-2008/089188 | A1 | 7/2008 |

OTHER PUBLICATIONS

Kosarev et al., "Recently Patent Facilities and Applications in Cold Spray Engineering," Recent Patents on Engineering, vol. 1 pp. 35-42 (2007).
Examination Report in European Patent Application No. 07843733.2, mailed Nov. 30, 2010 (9 pages).
English Translation of Office Action mailed Feb. 23, 2011 for Chinese Patent Application No. 200880023411.5 (7 pages).
Examination Report in European Patent Application No. 08755010.9, mailed Sep. 16, 2011 (3 pages).
"Cold Gas Dynamic Spray CGSM Apparatus," Tev Tech LLC, available at: http://www.tevtechllc.com/cold_gas.html (accessed Dec. 14, 2009).
"Cold Spray Process," Handbook of Thermal Spray Technology, ASM International, Sep. 2004, pp. 77-84.
Ajdelsztajn et al., "Synthesis and Mechanical Properties of Nanocrytalline Ni Coatings Producted by Cold Gas Dynamic Spraying," 201 Surface and Coatings Tech. 3-4, pp. 1166-1172 (Oct. 2006).
Examination Report in European Patent Application No. 09172234.8, mailed Jun. 16, 2010 (3 pages).
Gärtner et al., "The Cold Spray Process and its Potential for Industrial Applications," 15 J. of Thermal Sprsy Tech. 2, pp. 223-232 (Jun. 2006).
Hall et al., "The Effect of a Simple Annealing Heat Treatment on the Mechanical Properties of Cold-Sprayed Aluminum," 15 J. of Thermal Spray Tech. 2, pp. 233-238 (Jun. 2006.).
Hall et al., "Preparation of Aluminum Coatings Containing Homogeneous Nanocrystalline Microstructures Using the Cold Spray Process," JTTEES 17:352-359, (Jun. 2006).
IPRP in International Patent Application No. PCT/EP2006/003967, dated Nov. 6, 2007 (15 pages).
IPRP in International Patent Application No. PCT/US2008/062434, dated Nov. 10, 2009 (21 pages).
IPRP in International Patent Application No. PCT/EP2006/003969, mailed dated Nov. 6, 2007 (13 pages).
International Search Report and Written Opinion in International Patent Application No. PCT/US2007/087214, mailed Mar. 23, 2009 (13 pages).
IPRP in International Patent Application No. PCT/US2007/081200, dated Sep. 1, 2009 (17 pages).
IPRP in International Patent Application No. PCT/US2007/080282, dated Apr. 7, 2009 (15 pages).
Irissou et al., "Review on Cold Spray Process and Technology: Part I—Intellectual Property," 17 J. of Thermal Spray Tech. 4, pp. 495-516 (Dec. 2008).
Karthikeyan, "Cold Spray Technology: International Status and USA Efforts," ASB Industries, Inc. (Dec. 2004).
Li et al., "Effect of Annealing Treatment on the Microstructure and Properties of Cold-Sprayed Cu Coating," 15 J. of Thermal Spray Tech. 2, pp. 206-211 (Jun. 2006).
Marx et al., "Cold Spraying—Innovative Layers for New Applications," 15 J. of Thermal Spray Tech. 2, pp. 177-183 (Jun. 2006).
Morito, "Preparation and Characterization of Sintered Mo-Re Alloys," 3 J. de Physique 7, Part 1, pp. 553-556 (1993).
Search Report in European Patent Application No. 09172234.8, dated Jan. 29, 2010 (7 pages).
Stoltenhoff et al., "An Analysis of the Cold Spray Process and its Coatings," 11 J. of Thermal Spray Tech. 4, pp. 542-550 (Dec. 2002).
Van Steenkiste et al., "Analysis of Tantalum Coatings Produced by the Kinetic Spray Process," 13 J. of Thermal Spray Tech. 2, pp. 265-273 (Jun. 2004).

* cited by examiner

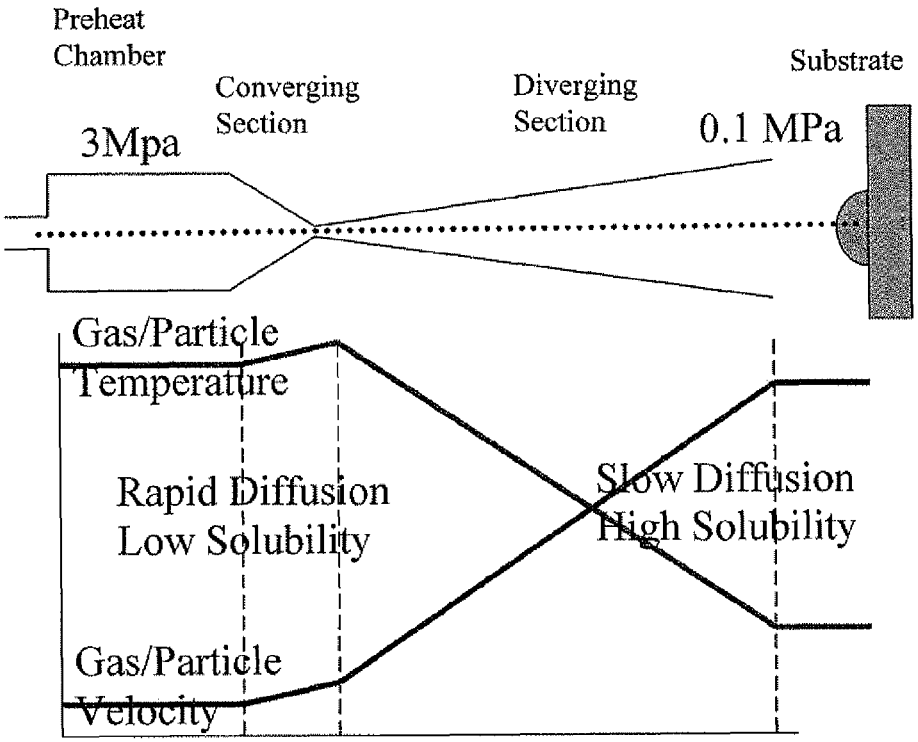
Figure 2. Simplified equipment schematic showing the different process conditions and where they exist within the device.

DYNAMIC DEHYDRIDING OF REFRACTORY METAL POWDERS

BACKGROUND OF THE INVENTION

Many refractory metal powders (Ta, Nb, Ti, Zr, etc) are made by hydriding an ingot of a specific material. Hydriding embrittles the metal allowing it to be easily comminuted or ground into fine powder. The powder is then loaded in trays and placed in a vacuum vessel, and in a batch process is raised to a temperature under vacuum where the hydride decomposes and the hydrogen is driven off. In principle, once the hydrogen is removed the powder regains its ductility and other desirable mechanical properties. However, in removing the hydrogen, the metal powder can become very reactive and sensitive to oxygen pickup. The finer the powder, the greater the total surface area, and hence the more reactive and sensitive the powder is to oxygen pickup. For tantalum powder of approximately 10-44 microns in size after dehydriding and conversion to a true Ta powder the oxygen pickup can be 300 ppm and even greater. This amount of oxygen again embrittles the material and greatly reduces its useful applications.

To prevent this oxygen pickup the hydride powder must be converted to a bulk, non hydride solid which greatly decreases the surface area in the shortest time possible while in an inert environment. The dehydriding step is necessary since as mentioned previously the hydride is brittle, hard and does not bond well with other powder particles to make usable macroscopic or bulk objects. The problem this invention solves is that of converting the hydride powder to a bulk metal solid with substantially no oxygen pickup.

SUMMARY OF THE INVENTION

We have discovered how to go directly from tantalum hydride powder directly to bulk pieces of tantalum a very short time frame (a few tenths of a second, or even less). This is done in a dynamic, continuous process as opposed to conventional static, batch processing. The process is conducted at positive pressure and preferably high pressure, as opposed to vacuum. The dehydriding process occurs rapidly in a completely inert environment on a powder particle by powder particle basis with consolidation occurring immediately at the end of the dehydriding process. Once consolidated the problem of oxygen pick up is eliminated by the huge reduction in surface area that occurs with the consolidation of fine powder into a bulk object.

Figure 1:
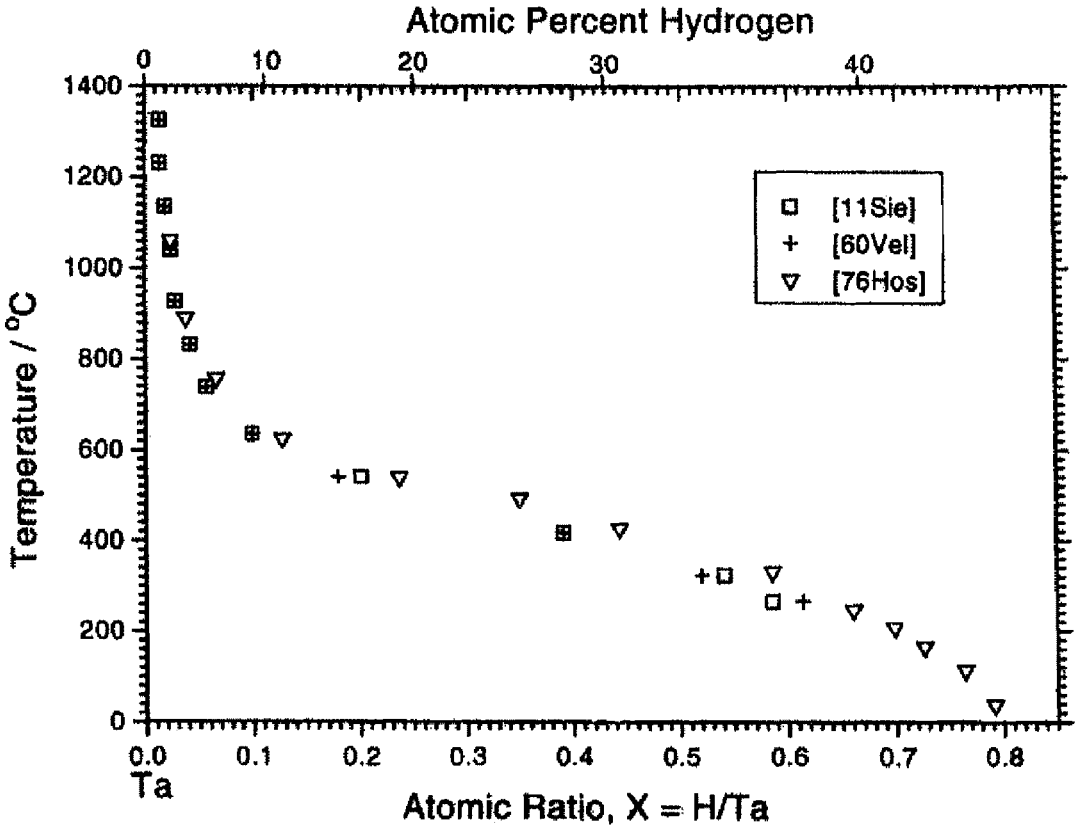
FIG. 1 is a graph showing solubility of H in Ta at atmospheric pressure From "the H—Ta (Hydrogen-Tantalum)

System" San-Martin and F. D. Manchester in *Phase diagrams of Binary Tantalum Alloys*, eds Garg, Venatraman, Krishnamurthy and Krishman, Indian Institue of Metals, Calucutta, 1996 pgs. 65-78.

FIG. 2 schematically illustrates equipment used for this invention, showing the different process conditions and where they exist within the device.

DETAILED DESCRIPTION OF THE INVENTION

The equilibrium solubility of hydrogen in metal is a function of temperature. For many metals the solubility decreases markedly with increased temperature and in fact if a hydrogen saturated metal has its temperature raised the hydrogen will gradually diffuse out of the metal until a new lower hydrogen concentration is reached. The basis for this is shown clearly in FIG. 1. At 200 C Ta absorbs hydrogen up to an atomic ratio of 0.7 (4020 ppm hydrogen), but if the temperature is raised to 900 C the maximum hydrogen the tantalum can absorb is an atomic ratio of 0.03 (170 ppm hydrogen). Thus, we observe what is well known in the art, that the hydrogen content of a metal can be controllably reduced by increasing the temperature of the metal. Note this figure provides data where the hydrogen partial pressure is one atmosphere.

Vacuum is normally applied in the dehydride process to keep a low partial pressure of hydrogen in the local environment to prevent Le Chateliers's principle from slowing and stopping the dehydriding. We have found we can suppress the local hydrogen partial pressure not just by vacuum but also by surrounding the powder particles with a flowing gas. And further, the use of a high pressure flowing gas advantageously allows the particles to be accelerated to a high velocity and cooled to a low temperature later in the process What is not known from FIG. 1, is if the temperature of the tantalum was instantly increased from room temperature to 900 C, how long would it take for the hydrogen concentration to decrease to the new equilibrium concentration level.

Information from diffusion calculations are summarized in Table 1. The calculations were made assuming a starting concentration of 4000 ppm hydrogen and a final concentration of 10 ppm hydrogen. The calculations are approximate and not an exact solution. What is readily apparent from Table 1 is that hydrogen is extremely mobile in tantalum even at low temperatures and that for the particle sizes (<40 microns) typically used in low temperature (600-1000 C) spraying operations diffusion times are in the order of a few thousandths of a second. In fact even for very large powder, 150 microns, it is less than half a second at process temperatures of 600 C and above. In other words, in a dynamic process the powder needs to be at temperature only a very short time be dehydrided to 10 ppm. In fact the time requirement is even shorter because when the hydrogen content is less than approximately 50 ppm hydrogen no longer causes embrittlement or excessive work hardening.

TABLE 1

Calculated hydrogen diffusion times in tantalum

| Temp. © | D (cm2/s) | Particle size 20 microns Time (s) | Particle size 40 microns Time (s) | Particle size 90 microns Time (s) | Particle size 150 microns Time (s) | Particle size 400 microns Time (s) |
|---|---|---|---|---|---|---|
| 200 | 1.11e−05 | 0.0330 | 0.1319 | 0.6676 | 1.8544 | 13.1866 |
| 400 | 2.72e−05 | 0.0135 | 0.0539 | 0.2728 | 0.7576 | 5.3877 |
| 600 | 4.67e−05 | 0.0078 | 0.0314 | 0.1588 | 0.4410 | 3.1363 |
| 800 | 6.62e−05 | 0.0055 | 0.0221 | 0.1120 | 0.3111 | 2.2125 |
| 1000 | 8.4e−05 | 0.0043 | 0.0174 | 0.0879 | 0.2441 | 1.7358 |
| Do = 0.00032* | | Q = −0.143 eV* | | | | |

*from From P. E. Mauger et. al., "Diffusion and Spin Lattice Relaxation of $^1$H in α $TaH_x$ and $NbH_x$", J. Phys. Chem. Solids, Vol. 42, No. 9, pp 821-826, 1981

FIG. 2 is a schematic illustration of a device designed to provide a hot zone in which the powder resides for a time sufficient to produce dehydriding followed by a cold zone where the powder residence time is too short to allow re-absorption of the hydrogen before the powder is consolidated by impact on a substrate. Note in the schematic the powder is traveling through the device conveyed by compressed gas going left to right. Conceptually the device is based on concepts disclosed in U.S. Pat. Nos. 6,722,584, 6,759,085, and 7,108,893 relating to what is known in the trade as cold spray apparatus and in U.S. patent applications 2005/0120957 A1, 2006/0251872 A1 and U.S. Pat. No. 6,139,913 relating to kinetic spray apparatus. All of the details of all of these patents and applications are incorporated herein by reference thereto. The design differences include: A) a preheat chamber where particle velocity and chamber length are designed not just to bring the powder to temperature but to retain the powder fully heated in the hot zone for a time in excess of those in Table 1 that will allow diffusion of the hydrogen out of the powder; B) a gas flow rate to metal powder flow rate ratio that insures that the partial pressure of hydrogen around the powder is low; C) a cooling chamber where particle residence time is sufficiently short to prevent substantial re-absorption of the hydrogen by the powder and accelerates the powder particle to high velocity; and D) a substrate for the powder to impact and build a dense deposit on.

The device consists of a section comprised of the well known De Laval nozzle (converging-diverging nozzle) used for accelerating gases to high velocity, a preheat-mixing section before or upstream from the inlet to the converging section and a substrate in close proximity to the exit of the diverging section to impinge the powder particles on and build a solid, dense structure of the desired metal.

An advantage of the process of this invention is that the process is carried out under positive pressure rather than under a vacuum. Utilization of positive pressure provides for increased velocity of the powder through the device and also facilitates or permits the spraying of the powder onto the substrate. Another advantage is that the powder is immediately desified and compacted into a bulk solid greatly reducing its surface area and the problem of oxygen pickup after dehydriding.

Use of the De Laval nozzle is important to the effective of operation of this invention. The nozzle is designed to maximize the efficiency with which the potential energy of the compressed gas is converted into high gas velocity at the exit of the nozzle. The gas velocity is used to accelerate the powder to high velocity as well such that upon impact the powder welds itself to the substrate. But here the De Laval nozzle also plays another key role. As the compressed gas passes through the nozzle orifice its temperature rapidly decreases due to the well known Joule Thompson effect and further expansion. As an example for nitrogen gas at 30 bar and 650 C before the orifice when isentropically expanded through a nozzle of this type will reach an exit velocity of approximately 1000 m/s and decrease in temperature to approximately 75 C. In the region of the chamber at 650 C the hydrogen in the tantalum would have a maximum solubility of 360 ppm (in one atmosphere of hydrogen) and it would take less than approximately 0.005 seconds for the hydrogen to diffuse out of tantalum hydride previously charged to 4000 ppm. But, the powder is not in one atmosphere of hydrogen, by using a nitrogen gas for conveying the powder, it is in a nitrogen atmosphere and hence the ppm level reached would be expected to be significantly lower. In the cold region at 75 C the solubility would increase to approximately 4300 ppm. But, the diffusion analysis shows that even in a high concentration of hydrogen it would take approximately 9 milliseconds for the hydrogen to diffuse back in and because the particle is traveling through this region at near average gas velocity of 600 m/s its actual residence time is only about 0.4 milliseconds. Hence even in a pure hydrogen atmosphere there is insufficient residence time for the particle to reabsorb hydrogen. The amount reabsorbed is diminished even further since a mass balance of the powder flow of 4 kg/hr in a typical gas flow of 90 kg/hr shows that even if all the hydrogen were evolved from the hydride, the surrounding atmosphere would contain only 1.8% hydrogen further reducing the hydrogen pickup due to statistical gas dynamics.

With reference to FIG. 2 the top portion of FIG. 2 schematically illustrates the chamber or sections of a device which may be used in accordance with this invention. The lower portion of FIG. 2 shows a graph of the gas/particle temperature and a graph of the gas/particle velocity of the powder in corresponding portions of the device. Thus, as shown in FIG. 2 when the powder is in the preheat chamber at the entrance to the converging section of the converging/diverging De Laval nozzle, the temperature of the gas/particles is high and the velocity is low. At this stage of the process there is rapid diffusion and low solubility. As the powder moves into the converging section conveyed by the carrier gas, the temperature may slightly increase until it is passed through the orifice and when in the diverging section the temperature rapidly decreases. In the meantime, the velocity begins to increase in the converging section to a point at about or just past the orifice and then rapidly increases through the diverging section. At this stage there is slow diffusion and high solubility. The temperature and velocity may remain generally constant in the portion of the device, after the nozzle exit and before the substrate.

One aspect of the invention broadly relates to a process and another aspect of the invention relates to a device for dehydriding refractory metal powders. Such device includes a preheat chamber at the inlet to a converging/diverging nozzle for retaining the metal powder fully heated in a hot zone to allow diffusion of hydrogen out of the powder. The nozzle includes a cooling chamber downstream from the orifice in the diverging portion of the device. In this cooling chamber the temperature rapidly decreases while the velocity of the gas/particles (i.e. carrier gas and powder) rapidly increases. Substantial re-absorption of the hydrogen by the powder is prevented. Finally, the powder is impacted against and builds a dense deposit on a substrate located at the exit of the nozzle to dynamically dehydride the metal powder and consolidate it into a high density metal on the substrate.

Cooling in the nozzle is due to the Joule Thompson effect. The operation of the device permits the dehydriding process to be a dynamic continuous process as opposed to one which is static or a batch processing. The process is conducted at positive and preferably high pressure, as opposed to vacuum and occurs rapidly in a completely inert or non reactive environment.

The inert environment is created by using any suitable inert gas such as, helium or argon or a nonreactive gas such as nitrogen as the carrier gas fed through the nozzle. In the preferred practice of this invention an inert gas environment is maintained throughout the length of the device from and including the powder feeder, through the preheat chamber to the exit of the nozzle. In a preferred practice of the invention the substrate chamber also has an inert atmosphere, although the invention could be practiced where the substrate chamber is exposed to the normal (i.e. not-inert) atmosphere environment. Preferably the substrate is located within about 10 millimeters of the exit. Longer or shorter distances can be used within this invention. If there is a larger gap between the substrate chamber and the exit, this would decrease the effectiveness of the powder being consolidated into the high density metal on the substrate. Even longer distances would result in a loose dehydrided powder rather than a dense deposit.

Experimental Support

The results of using this invention to process tantalum hydride powder −44+20 microns in size using a Kinetiks 4000 system (this is a standard unit sold for cold spray applications that allows heating of the gas) and the conditions used are shown in Table II. Two separate experiments were conducted using two types of gas at different preheat temperatures. The tantalum hydride powder all came from the same lot, was sieved to a size range of −44+20 microns and had a measured hydrogen content of approximately 3900 ppm prior to being processed. Processing reduced the hydrogen content approximately 2 orders of magnitude to approximately 50-90 ppm. All this was attained without optimizing the gun design. The residence time of the powder in the hot inlet section of the gun (where dehydriding occurs) is estimated to be less than 0.1 seconds, residence time in the cold section is estimated to be less than 0.5 milliseconds (where the danger of hydrogen pickup and oxidation occurs). One method of optimization would simply be to extend the length of the hot/preheat zone of the gun, add a preheater to the powder delivery tube just before the inlet to the gun or simply raise the temperature that the powder was heated to.

TABLE II

Experimental results showing the hydrogen decrease in tantalum powder using this process

| Gas Type | Gas Pressure (Bar) | Gas Temperature © | Initial Hydrogen Content (ppm) | Final Hydrogen Content (ppm) |
|---|---|---|---|---|
| Helium | 35 | 500 | 3863 | 60,85 |
| Nitrogen | 35 | 750 | 3863 | 54,77 |

As noted the above experiment was performed using a standard Kinetecs 400 system, and was able to reduce hydrogen content for tantalum hydride to the 50-90 PPM level for the powder size tested. I.e. the residence time in hot sections of the standard gun was sufficient to drive most of the hydrogen out for tantalum powders less than 44 mictons in size.

The following example provides a means of designing the preheat or prechamber to produce even lower hydrogen content levels and to accommodate dehydriding larger powders that would require longer times at temperature. The results of the calculations are shown in table III below

TABLE 1

Example calculations to determine prechamber configuration.

| | Tantalum (10 um) H = 4000 ppm | Niobium (10 um) H = 9900 ppm |
|---|---|---|
| Avg. Particle Temperature in the prechamber (C.) | 750 | 750 |
| Initial Particle Velocity at the nozzle inlet (m/sec) | 4.49E−02 | 4.37E−02 |
| Dehydriding Time (100 ppm) (sec) | 1.31E−03 | 1.10E−03 |
| Dehydriding Time (50 ppm) (sec) | 1.49E−03 | 1.21E−03 |
| Dehydriding Time (10 ppm) (sec) | 1.86E−03 | 1.44E−03 |
| Prechamber Residence Time (sec) | 1.86E−03 | 1.44E−03 |
| Avg. Particle Velocity in the Prechamber (m/sec) | 4.00E−02 | 4.00E−02 |
| Prechamber Length (mm) | 0.074 | 0.058 |
| | **Tantalum (400 um) H = 4000 ppm)** | **Niobium (400 um) H = 9900 ppm** |
| Avg. Particle Temperature in the prechamber (C.) | 750 | 750 |
| Initial Particle Velocity at the nozzle inlet (m/sec) | 3.46E−04 | 6.73E−04 |
| Dehydriding Time (100 ppm) (sec) | 2.09E+00 | 1.75E+00 |
| Dehydriding Time (50 ppm) (sec) | 2.39E+00 | 1.94E+00 |
| Dehydriding Time (10 ppm) (sec) | 2.97E+00 | 2.30E+00 |
| Prechamber Residence Time (sec) | 2.97 | 2.30 |
| Avg. Particle Velocity in the Prechamber (m/sec) | 3.00E−04 | 6.00E−04 |
| Prechamber Length (mm) | 0.892 | 1.382 |

The calculations are for tantalum and niobium powders, 10 and 400 microns in diameter, that have been assumed to be initially charged with 4000 and 9900 ppm hydrogen respectively.

The powders are preheated to 750 C. The required times at temperature to dehydride to 100, 50 and 10 ppm hydrogen are shown in the table are shown. The goal is to reduce hydrogen content to 10 ppm so the prechamber length is calculated as the product of the particle velocity and the required dehydriding time to attain 10 ppm. What is immediately apparent is the reaction is extremely fast, calculated prechamber lengths are extremely short (less than 1.5 mm in the longest case in this example) making it easy to use a conservative prechamber length of 10-20 cm insuring that this dehydriding process is very robust in nature, easily completed before the powder enters the gun, and able to handle a wide range of process variation.

What is claimed is:

1. A method for dehydriding, the method comprising:

heating a metal hydride powder, to decrease a hydrogen content thereof, in a preheat chamber comprising a converging portion of a nozzle, thereby forming a metal powder substantially free of hydrogen;

cooling the metal powder in a cooling chamber (i) in communication with the preheat chamber, and (ii) comprising a diverging portion of the nozzle, for a sufficiently small cooling time to prevent reabsorption of hydrogen into the metal powder; and thereafter, depositing the metal powder on a substrate to form a solid deposit.

2. The method of claim 1, wherein a distance between an outlet of the cooling chamber and the substrate is less than approximately 10 mm.

3. The method of claim 1, wherein heating of the metal hydride powder and the cooling of the metal powder are performed under a positive pressure of an inert gas.

4. The method of claim 1, wherein a hydrogen content of the metal hydride powder is greater than approximately 3900 ppm before heating.

5. The method of claim 1, wherein a hydrogen content of the metal powder is less than approximately 100 ppm after it is deposited.

6. The method of claim 5, wherein the hydrogen content of the metal powder is less than approximately 50 ppm after it is deposited.

7. The method of claim 1, wherein the metal hydride powder comprises a refractory metal hydride powder.

8. The method of claim 1, wherein an oxygen content of the solid deposit is less than approximately 200 ppm.

9. The method of claim 1, wherein the metal powder is deposited by spray deposition.

10. The method of claim 9, wherein the metal powder is deposited by cold spray.

11. The method of claim 1, wherein a hydrogen content of the metal hydride powder decreases by at least two orders of magnitude during heating.

12. The method of claim 1, wherein an oxygen content of the metal powder does not increase during cooling.

13. The method of claim 1, wherein a length of the preheat chamber along a direction of travel of the metal hydride powder from the preheat chamber to the cooling chamber is at least approximately 0.074 mm.

14. The method of claim 13, wherein the length of the preheat chamber is at least approximately 1.382 mm.

15. The method of claim 1, further comprising providing an inert gas within the preheat chamber and the cooling chamber.

16. The method of claim 1, wherein forming the solid deposit substantially prevents oxygen absorption into the metal powder.

* * * * *